United States Patent [19]

Davis et al.

[11] Patent Number: 4,773,142

[45] Date of Patent: Sep. 27, 1988

[54] METHODS OF MAKING HEAD SUPPORT CUSHIONS

[76] Inventors: James R. Davis, 18 Denbow Rd.; Michael P. McConnell, 25 Faculty Rd., both of Durham, N.H. 03824

[21] Appl. No.: 15,430

[22] Filed: Feb. 17, 1987

Related U.S. Application Data

[62] Division of Ser. No. 742,761, Jun. 10, 1985, Pat. No. 4,679,262.

[51] Int. Cl.[4] ..... B68G 7/00

[52] U.S. Cl. ..... 29/91.1; 112/262.1

[58] Field of Search ..... 29/91.1, 91; 5/434, 5/441, 436, 437, 446, 490; 297/391, 392, 393; 112/262.1

[56] References Cited

U.S. PATENT DOCUMENTS 3,245,719 4/1966 Davidson ..... 29/91.1

FOREIGN PATENT DOCUMENTS 76325 9/1970 German Democratic Rep. .... 5/441
2135425 1/1973 Fed. Rep. of Germany ..... 5/441
57906 9/1936 Norway ..... 5/441

*Primary Examiner*—P. W. Echols
*Assistant Examiner*—Irene Cuda
*Attorney, Agent, or Firm*—Nutter, McClennen & Fish

[57] ABSTRACT

A cushion for supporting the head of a user reposing in a sitting or semi-reclining position comprises a relatively stiff body constituting a segment of a torus. The length and curvature of the body are such that when the body is positioned on the user's shoulder at one side of the midsagittal plane, the body extends from a location adjacent to the mastoid process behind the user's ear forwardly to a point beyond the midsagittal plane to the mental terminus of the user's mandible so that said body provides positive anatomically correct support for the user's head no matter which direction the head nods or tilts to said one side of the midsagittal plane. A novel method of making the cushion is also disclosed.

8 Claims, 4 Drawing Sheets

METHODS OF MAKING HEAD SUPPORT CUSHIONS

Related Applications

This application is a division of application Ser. No. 742,761, filed June 10, 1985, now U.S. Pat. No. 4,679,262.

This invention relates to a head support cushion for supporting the user's head when he is reposing in a sitting or semi-reclining position. It also relates to methods of making such a cushion.

BACKGROUND OF THE INVENTION

When one is sitting on a chair or seat, the muscles of the neck must be contracted continuously to maintain the head in an erect position. If the sitting position must be maintained for a prolonged period, this constant strain on the neck muscles causes fatigue and sometimes neck pain. If one tries to relax to avoid this problem, the head will incline or nod, usually forwardly, to one side or the other of the midsagittal plane. When the head reaches the limit of its excursion, the neck strain reoccurs. Also, there may be an involuntary contraction of the neck muscles as they try to return the head to its normal erect position which places an additional strain on the neck that causes muscle soreness and neck pain. Infirm people and invalids who must sit up for prolonged periods in nursing homes and rehabilitation facilities are particulary prone to these problems. So are normal healthy travelers on common carriers.

To help alleviate the aforesaid problems, people place pillows between their heads and the backs of the seats or they tuck pillows between their heads and shoulders to prop up their heads to try to hold their heads in positions most comfortable for themselves. However, such pillows provide only marginal support at best because they tend to conform to the head envelope and they do not provide pressure at those points most calculated to position the head to minimize neck strain.

Because of the unsatisfactory performance of pillows for this purpose, considerable energy has been expended to develop cushions to provide better support for a sitter's head. These prior cushions can be classified by their uses or by the kinds of support that they provide. Most cushions are designed for the reclining, i.e. sleeping or prone, user. However, some of them are designed for the upright, i.e. standing, sitting or semi-reclining, user. Cushions may be calculated to support the head or to support other anatomical parts such as the back, arms or legs. Of those cushions designed for the head, they may support the back of the head, one or both sides of the head or the chin at the front of the head.

Most prior head-support cushions are more or less two dimensional structures relying on the cushion's bulk and compliance to provide the requisite support. That is, most are not shaped to fit human contours. Like the ordinary bed pillow, they possess no particular shape to support the individual's head; rather, they conform to the head outline as noted above. Pillows for reclining individuals are usually shaped to fit the neck and head area either to provide additional support for the neck and head or to provide support while avoiding contact with the user's hair so that they do not disturb the user's hairdo. U.S. Pat. Nos. 3,312,987 and 3,327,330 disclose pillows of that type.

Prior support cushions and pillows for the upright user are designed to support the rear of the head and to provide some lateral support. They were developed under the assumption that the center of gravity of the head lies behind the vertical plane passing through the center of the seventh cervical vertebra so that the weight of the head is borne by the back of the chair or seat. We have found, however, that is assumption is incorrect for two reasons: (1) with few exceptions because most seat backs, including the bench seats in automobiles, do not extend beyond the average person's shoulders. Thus, they actually provide inadequate support for the rear of the head, and (2) with few exceptions, the seats in most forms of conveyance including aircraft and trains do not recline far enough to transfer the weight of the head to the back of the seat. Instead, when the neck muscles relax, the head falls forward to one side or the other of the midsagittal plane.

Those prior pillows and cushions designed specifically to provide head support for a person sitting upright are usually symmetrical and tubular structures which seek to support the head by supporting the back of the neck, usually by filling the gap between the neck and the back of the chair or seat. Examples of such cushions are described in U.S. Pat. Nos. 98,859; 2,328,871; 3,312,987; 3,667,074 and 4,161,794. There are some prior support cushions which are not symmetrical, such as those disclosed in U.S. Pat. Nos. 673,872; 1,787,832; 2,336,707; 2,522,120 and 4,060,863. However, those cushions do not provide adequate support at the back of the head. The last-mentioned patent does provide some neck support on the back 180° of the neck, but this cushion has narrow tapered ends disposed at both sides of the neck so that it does not provide side support for the head.

Other prior pillows approach the problem by providing a cavity or indentation for the neck and head of the user, usually when he is in a reclining position. See U.S. Pat. Nos. 2,880,428 and 3,521,310. Of those cavity-type cushions that are designed for the upright user, the cushion defines a yoke or horseshoe structure which is cumbersome in addition to being unsightly as evident from U.S. Pat. Nos. 2,336,707 and 2,522,120.

In general, those cushions which do adequately inhibit movements of the head in one direction do not adequately support the head against such movements in other directions. For example, the cushion described in U.S. Pat. No. 4,345,347 which incorporates a raised back supports the back of the head adequately, but has small side wings to avoid stifling the user and thereby fails to support the sides of the head effectively. On the other hand, the pillow depicted in U.S. Pat. No. 4,031,578 which does provide adequate lateral head support fails to lend such support at the front and rear of the head.

Thus, to date, to applicants' knowledge, no support cushion exists that provides any support in the front of the head, let alone a combination of the three types of support required to properly support the head of a user reposing in an upright or semi-reclining position. That is, no single prior pillow is able to properly support the rear of the head, the sides of the head at the jawline and, most importantly, the front of the head at the chin. Instead, the prior pillows concentrate on forming a rough contour that permits the head to loll or fall into it. The support from such pillows depends, therefore, on gravity pushing the head to the pillow. Thus, the users of such conventional cushions who are asleep are particularly prone to tossing and lolling which movements tend to awaken them so that they have a fitful rest at best.

Finally, from appearance and marketing standpoints, the prior art cushions, of which the above-identified patented cushions are representative, are generally too large to be practical and so unsightly as to discourage their widespread use on airplanes and other common carriers by captive sitters who would certainly prefer to alight from their flight fully rested and without neck pain.

SUMMARY OF THE INVENTION

Accordingly, it is an object of the present invention to provide an improved head support cushion.

Another object of the invention is to provide a single cushion which is able to properly support the front, back and either side of the user's head.

A further object of the invention is to provide a head support cushion which is relatively compact and comely so that it can be carried conveniently and is not unsightly when used in public on common carriers and the like.

Still another object of the invention is to provide a head support cushion which is comfortable to use and which enhances the ability of a traveler to obtain a restful sleep when sitting for a prolonged period.

Another object of the invention is to provide a head support cushion which minimizes neck strain and pain for persons forced to remain in a sitting or semi-reclining position for a long time.

Yet another object of the invention is to provide a cushion of this type which is relatively inexpensive to make and is easy to clean and otherwise maintain.

A further object of the invention is to provide methods of making a support cushion having one or more of the foregoing advantages.

Other objects will, in part, be obvious and will, in part, appear hereinafter.

The invention accordingly comprises the sequence of steps and the features of construction, combination of elements and arrangement of parts which will be exemplified in the following detailed description, and the scope of the invention will be indicated in the claims.

Briefly, our head support cushion is superior to prior cushions of this general type because it takes advantage of the anatomical and biomechanical characteristics of the user's head, neck and shoulders to provide full anatomically correct support for the head of a user relaxing or sleeping in a relatively upright position. That is, this single cushion provides all three types of head support, namely at the back, front and side of the head. The cushion is a three-dimensional, quasi-toroidal structure whose shape and contour are correlated to the user's anatomy so that it has support or pressure areas at the key locations required to support the user's chin, jawline and head to keep the user's head tilted comfortably to one side or the other of the midsagittal plane. In use, the cushion is held in place between the user's head, shoulder and chest by the compression forces produced by the weight of the head itself. Therefore, it remains in place and lends its support even when the user falls asleep. However, the shape of the pillow, while altering slightly, does not appreciably change its supporting shape.

Thus, even when the user dozes or nods off, our cushion insures that his head remains supported in an anatomically correct position. This minimizes the chances of his awaking involuntarily due to uncontrolled lolling movements of his head. Resultantly, the user is much more comfortable because his head is supported at exactly those points where it needs to be supported. This is in sharp contrast to those prior pillows discussed above which rely on a dynamic conformance of the pillow to the shape of the head or to a partial pillow shaping due to the head's simply resting on the pillow.

Yet the cushion, due to its novel configuration, only has to support the head on one side. Consequently, it is a much more compact and comely cushion than those conventional cumbersome yoke and horeseshoe shapes that capture the user's head. Moreover, the cushion is convenient to carry and to use and the individual wearing the cushion will not feel stifled or embarrassed when using the cushion in public.

The cushion can be constructed as a solid, stuffed or inflatable structure which is relatively stiff, yet which is pliable enough to accommodate some conformance to the user's anatomy. Preferably, it has a surface material which is somewhat absorbent and pleasing to the touch and has no wrinkles to form objectionable marks on the user's facial skin even when used continuously for a long period. Since the cushion is a small and simple structure with no moving parts, it can be made relatively inexpensively and it is easily maintained in presentable form by periodic washing or cleaning. Indeed, an especially low-cost inflatable or stuffed version of the cushion can be made with an outer cover formed from a single flexible sheet which is folded, cut and sealed in a special way to be described later in detail.

BRIEF DESCRIPTION OF THE DRAWINGS

For a fuller understanding of the nature and objects of the invention, reference should be had to the following detailed description, taken in connection with the accompanying drawings, in which:

FIG. 5 and FIGS. 5A and 5B are views similar to FIGS. 2A and 2C of a slightly different cushion embodiment;

DETAILED DESCRIPTION OF THE PREFERRED EMBODIMENTS

Figure 1:
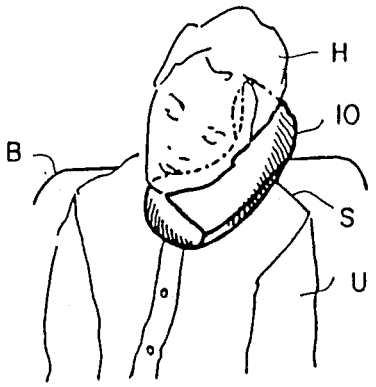
FIG. 1 is an isometric view showing an individual using the head support cushion of this invention.
Figure 4A:
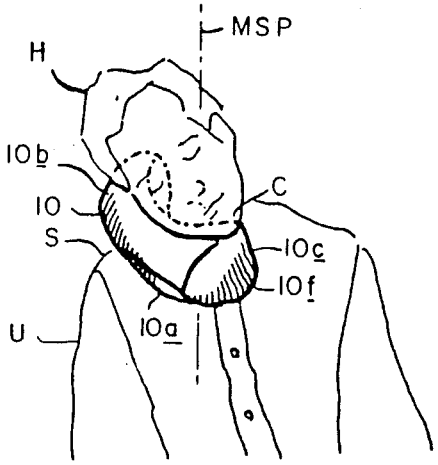
FIGS. 4A, 4B, 4C and 4D are views similar to FIG. 1 showing the different types of support provided by the FIG. 1 cushion.

Referring first to FIG. 1 of the drawings, the head support cushion 10 of this invention is designed to be worn by a user U while he is sitting upright or in a semi-reclining position, such as in a chair B. The cushion is positioned at one side or the other of the user's head H and nestles in the cleft between that person's head H and shoulder S. In FIG. 1, the cushion 10 is positioned on the left shoulder S of the user and supports his head from the left side; FIG. 4A illustrates the same cushion located on the user's right shoulder S, supporting his head from the right side. In either event, the shape of the cushion 10, best shown in FIGS. 2A to 2C and to be described in detail presently, provides full anatomically correct support at the front, back and side of the head when the user is awake, relaxing or dozing and even when he is in a deep sleep. As shown in FIG. 1, the cushion is captured between the user's head H and his shoulder S and between his chin and chest so that the cushion remains in place even if the user moves while he is asleep.

Unlike a standard bed pillow, cushion 10 is a relatively stiff structure that holds its illustrated shape. Yet, it does have some pliability and resiliency so that it is not uncomfortable to use even for a prolonged period. The cushion can be constructed from a single piece of solid or foamed rubber or plastic material, with the cushion preferably being covered by a fabric or other material which is absorbent and soft to the touch. That cover may even be removable for washing or cleaning purposes.

The cushion may also exist in the form of a flexible pouch stuffed with particulate material, filaments, feathers or pieces of foam rubber. It can even be made as an inflatable bladder so that, when not in use, the cushion can be deflated, rolled up and stored in the user's pocket or purse. These hollow filled cushions are especially lightweight. Also, the stiffness of the inflatable cushion and thus the cushion's degree of support may be varied to some extent by controlling the inflating pressure. This will also fit the cushion to the idiosyncracies of each person's anatomy. The inflatable cushion 10 should also have a soft outer surface or cover so that the cushion will be comfortable to use.

Whether the cushion is made as a solid article or as a stuffed or inflatable one, it is relatively easy and inexpensive to manufacture in quantity. Furthermore, having no moving parts, it is easy to clean and maintain, particularly if it has a removable outer cover as described above. Since it is worn only at one side of the head, the cushion is quite unobtrusive so that one does not become uncomfortable or embarrassed using it in public. Therefore, our cushion should prove to be a popular and useful article for travelers to carry on long trips or for common carriers to provide for their passengers. It should also find widespread use in nursing homes and hospitals where persons are required to sit for long periods of time.

Figure 3A:
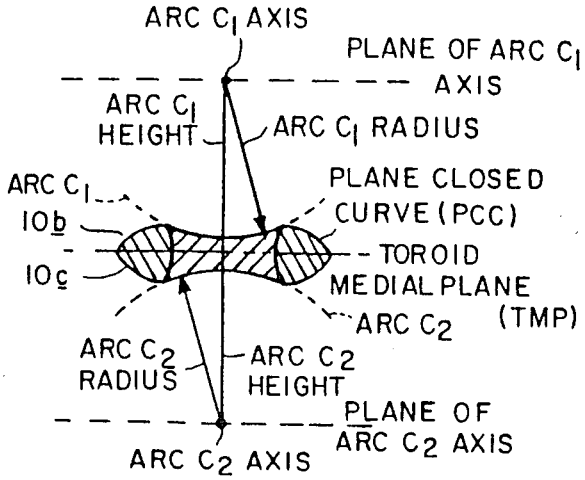
FIGS. 3A and 3B are diagrammatic views describing the shape and surface configuration of the FIG. 1 support.
Figure 3B:
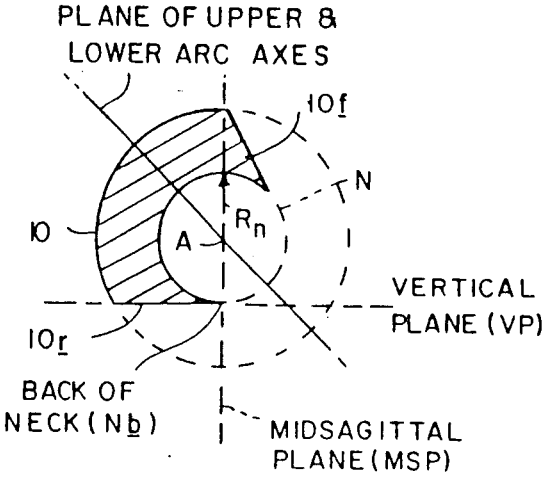

The specific shape of the cushion 10 may best be understood with reference to drawing FIGS. 3A and 3B. FIG. 3A is a geometrical representation of a person's neck area in side elevation, while FIG. 3B represents a transverse section through the neck area. In FIG. 3B, the inner circle N represents a person's neck with the back of the neck $N_b$ and the midsagittal plane MSP through the neck being indicated in that figure.

The desired form of cushion 10 is a segment 10 of a generally toroidal shape formed by rotating a plane closed curve PCC about the axis A at the center of the circle N, which curve intercepts two cylindrical arcs $C_1$ and $C_2$ whose axes are parallel to the toroid's transverse medial plane TMP and offset above and below that plane so that those arcs $C_1$ and $C_2$ approximate the arc formed by the outer edge of the user's jaw J from the mastoid process M to the mental terminus of the mandible or chin C. (See FIGS. 4B and 4D). Further, as shown in FIG. 3B, the axes of the two cylindrical arcs $C_1$ and $C_2$ should lie in a plane AP which is rotated approximately 45° from the user's midsagittal plane MSP (also indicated in FIG. 4A). Furthermore, the rear end **10*r* of the toroidal segment 10 is defined by the intersection of that segment with the vertical plane VP illustrated in FIG. 3B that is tangent to the back of the neck-representing circle at $N_b$. The toroidal segment 10 should curve forwardly around circle N to a point beyond the midsagittal plane MSP as shown in FIG. 3B and the forward end 10*f* of the segment is cut or shaped vertically in such a way that, when the segment 10 is rotated about circle N until its end 10*f* reaches point $N_b$ thereon, that end 10*f* will also lie in the tangent plane VP. Accordingly, the thus defined toroidal segment 10 has the shape of the shaded areas in FIGS. 3A and 3B and the arc length of segment 10** is on the order of 7 to 15 inches.

Using the aforesaid principles, a family of triangular-shaped plane closed curves PCC has been found to provide acceptable head support for most individuals. The preferred shape of that curve should approximate a triangle with rounded sides constructed of equal-length arcs **10*a*, 10*b*, 10*c* with the apex of the triangle at the perimeter of the toroidal segment 10 pointing away from the neck as shown in FIG. 3A. The length of those three arcs should ideally be equal to the distance from the top of the trapezius muscle T at the base of the user's neck to the mastoid process M located just behind his ear. See FIG. 4D**. This distance may vary with the age, gender and degree of muscularity of the user. However, a length of about 5 to 6 inches has been found empirically to be reasonably comfortable for the majority of adult users.

The inner radius of the toroidal segment 10 should be slightly longer than the radius $R_n$ of the neck circle 10 as indicated in FIG. 3B, e.g., 2 to 4 inches. This radius may also vary with the age, gender and degree of muscularity of the user. Thus, for example, the inner radius of cushion 10 would be about 3 inches for a user U with a size 16 neck N.

Figure 4C:
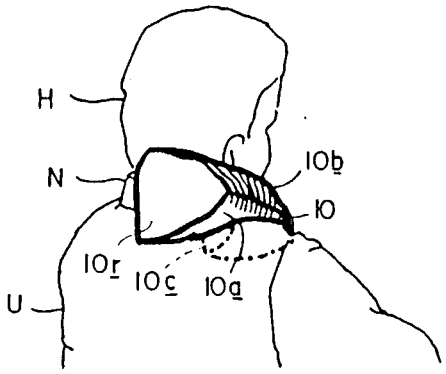
Figure 4B:
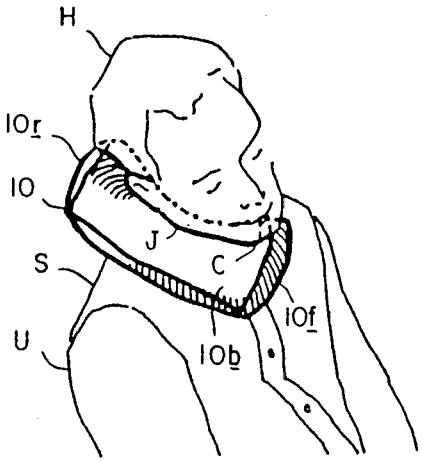

The heights of the axes of the cylindrical arcs $C_1$ and $C_2$ above and below the toroidal plane TMP shown in FIG. 3A should be about 1.5 to 2 inches longer than the arc radii to generate arcs $C_1$ and $C_2$ that fit the curvature of the average user's jaw J (FIG. 4B). An arc radius of about 16 to 18 inches has been shown empirically to produce a cushion 10 that fits the majority of adult users.

Figure 2A:
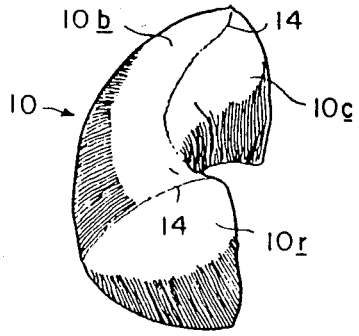
FIGS. 2A, 2B and 2C are isometric views on a larger scale showing the FIG. 1 cushion from different vantage points.
Figure 2B:
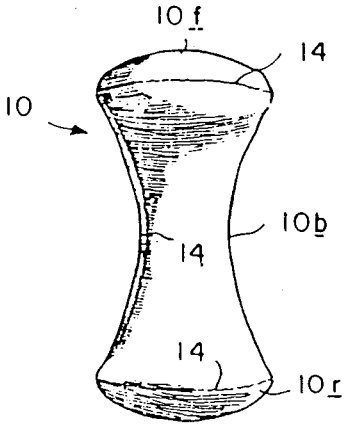
Figure 2C:
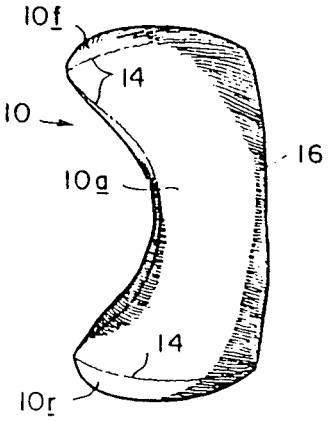

FIGS. 2A, 2B and 2C show cushion 10 in detail with the parts or panels of that cushion corresponding to the lines comprising FIGS. 3A and 3B bearing the same identifying numbers. As seen in the former set of figures, the shape of cushion 10 conforms very closely to the shape of the shaded closed-curve toroidal segment 10 depicted in FIGS. 3A and 3B.

Refer now to FIGS. 4A to 4D which illustrate the support given by a cushion 10 positioned on the user's right shoulder S for different inclinations of the user's head H. In FIG. 4A, the user's head H is inclined directly to the right. As shown there, cushion 10 provides full lateral support between the user's jaw J and the shoulder S, the flared ends of the cushion preventing longitudinal movement of the cushion. As best seen in FIG. 4B, the flared cushion ends provide support for the side of the user's head and his chin C, while presenting a tapered narrower bridge to support the head along the entire line of the jaw J from the mastoid process M to the mental terminus of the mandible at C. Thus, in both the FIGS. 4A and 4B positions, the flared-forward segment of the cushion 10 provides full anatomical support for the chin C as the head tilts in the ventro-lateral direction, keeping the head tilted comfortably to one side of the midsagittal plane MSP.

Figure 4D:
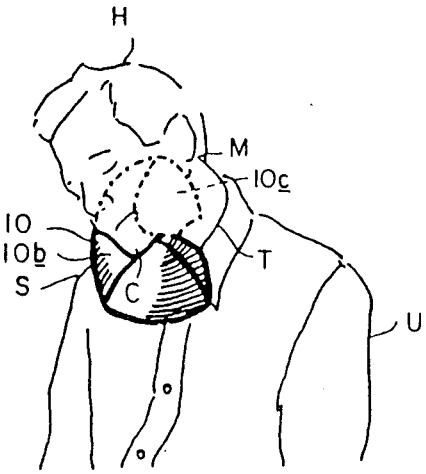

As shown in FIG. 4C, the flared rear segment of the cushion is positioned directly under the user's mastoid process M near the back of the head, the user's head being supported comfortably from the rear so that there is minimum strain on his neck. The head support 10 is a symmetrical structure that can be used on either side of the head without modification. It is retained in place by the biomechanical elements of the body such as the shoulder, jaw and chin. Thus, it is held in place by the compression forces generated by the head laterally as shown in FIG. 4A and by the chin ventro-laterally as seen in FIG. 4D. Laterally, the compression force of the head wedges the base of the triangular cushion cross section against the bulge formed by the junction of the clavicle and the coronoid and acromion processes of the scapula. Ventrally, the jaw J hooks over the top of the triangular cushion form as best seen in FIGS. 4B and 4D, with the weight of the head wedging the cushion between the jaw and the upper chest. The flared triangular enlargements at the ends of the cushion keep the head from rocking back and forth if and when he moves or his chair or seat is moved as would be the case if he were sitting in a moving vehicle. The flared cushion ends also insure that the cushion can be used to support the head laterally and the back of the neck as well as in those situations where the user's chair B (FIG. 1) can recline sufficiently to transfer the weight of the head completely to the back of the chair.

Figure 5A:
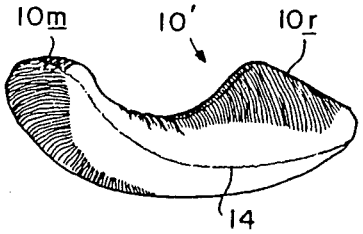
Figure 5B:
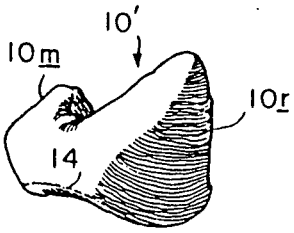

Although the illustrated cushion 10 is symmetrical end to end, other cushion embodiments may not be symmetrical. For example, FIGS. 5A and 5B illustrate a head support cushion 10' whose rear end **10*r* is triangular like the rear end 10*r* of cushion 10. However, its forward end 10*m*** is rounded having a sufficiently large flare or bulge to support the user's chin C and keep his head H from shifting with his body movements. Due to the asymmetry of this cushion embodiment, left-side and right-side versions are required to accommodate the different users' preferred resting positions.

As discussed above, the support cushion is usually rather stiff. However, even rigid versions can be made which are still quite comfortable provided that a slight axial twist is included in the cushion between its two ends. Rigid cushions with a twist of approximately 15° from end to end have been found to be suitable. It should be understood, however, that the various cushion embodiments should be pliable enough to accommodate some distortion in the transverse medial plane of the cushion and to present a soft exterior surface for the user's comfort.

When the illustrated cushion 10 is made as a stuffed or inflatable structure, its outer cover may be composed of five separate pieces of material. The shapes of those pieces correspond to the shapes of cushion panels **10*a*, 10*b*, 10*c*, 10*f* and 10*r* depicted in FIGS. 2A, 2B and 2C. The edges of those panels are secured together at the seam lines 14 shown in those figures by stitching, heat-sealing, adhesive or other appropriate means. Before completing the final seam of a stuffed cushion, the cushion stuffing may be inserted to give the article its finished shape shown in those figures. If the cushion 10 is inflatable, an appropriate air valve may be included in the structure at a location thereon not likely to contact the user, say, near the perimeter of the cushion as indicated in dotted lines at 16 in FIG. 2C. Valve 16** may be a simple inexpensive valve of the type used on inflatable game balls whose protruding end can be pushed into the inflated structure when not in use.

A stuffed or inflatable version of our cushion may even be constructed from a single sheet of material using a novel technique which we have developed. Such a cushion can be made at very low cost so that it could even be handed out by the railroads and airlines as single-use or disposable items for their passengers. A novel method of making this cushion is illustrated in FIGS. 6A to 6E with the cushion itself being shown at 30 in FIG. 6F.

Figure 6F:
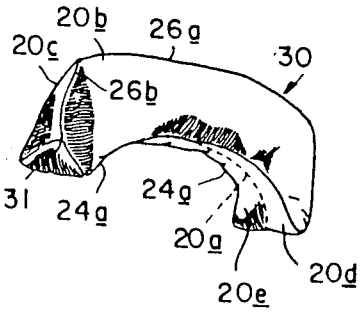
FIGS. 6A to 6F show the steps for making a low-cost version of the head support cushion.
Figure 6A:
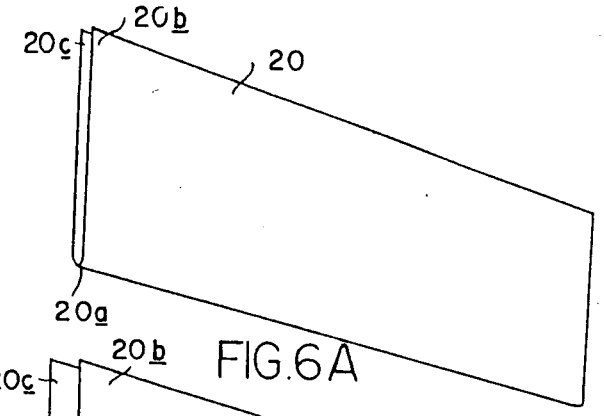
Figure 6B:
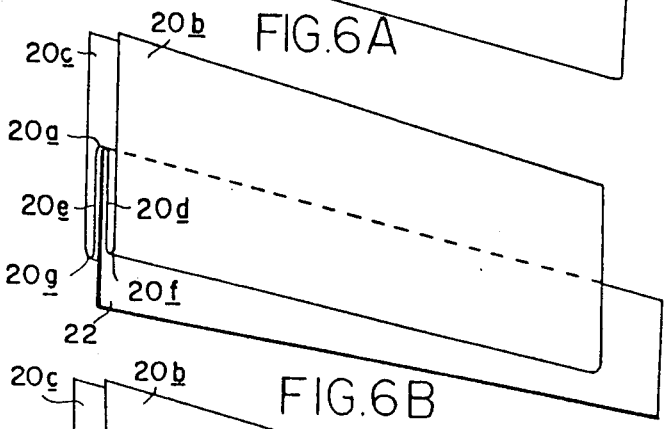

To make cushion 30, first, a generally rectangular sheet 20 of flexible fabric or plastic material is folded over on itself at **20*a* to form upper and lower layers or plies 20*b* and 20*c* as shown in FIG. 6A. Then, a relatively rigid separator or guide 22 is pushed edge-on against sheet 20 at its fold 20*a* as shown in FIG. 6B to reverse fold or pleat sheet 20 to create two internal plies 20*d* and 20*e*. Thus, two plies 20*b* and 20*d* joined at a fold line 20*f* lie above separator 22 and two plies 20*e* and 20*c* joined at a fold line 20*g* exist below the separator as seen in FIG. 6B**.

Figure 6C:
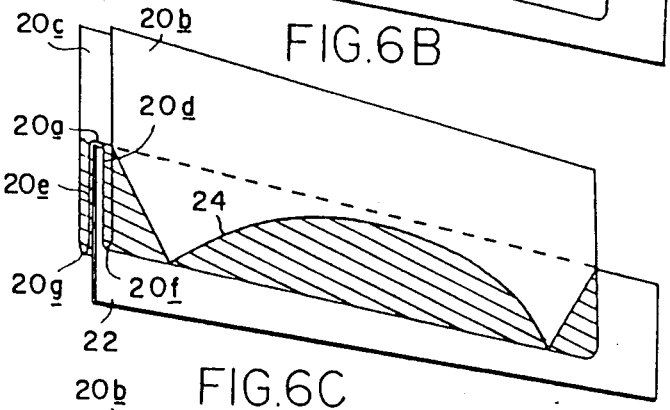

Referring now to FIG. 6C, with the separator 22 still in place, the two plies **20*b* and 20*d* above the separator are cut and seamed or sealed along a seam line 24 with the excess material indicated by the shaded area in FIG. 6C being removed. The cut or seamline 24 is composed of three segments. A central segment 24*a* has a generally cylindrical curvature corresponding to the curvature of the neck radius $R_n$ in FIG. 3B and its opposite ends are located at points on fold line 20*f* spaced from the opposite side edges of sheet 20. A pair of mirror-image straight end segments 24*b* extend from the opposite ends of segment 24*a* to the opposite ends of the fabric fold line 20*a*** now located near the longitudinal centerline of the folded-over sheet.

The two sheet plies **20*e* and 20*c* below separator 22 are similarly cut and seamed together along a seam line identical to the line 24 illustrated in FIG. 6C with the excess material shown by shading being removed. The upper and lower seams 24 can be made at the same time by dies approaching the material from above and below or in two steps using a single die by inverting the folded sheet 20**.

Figure 6D:
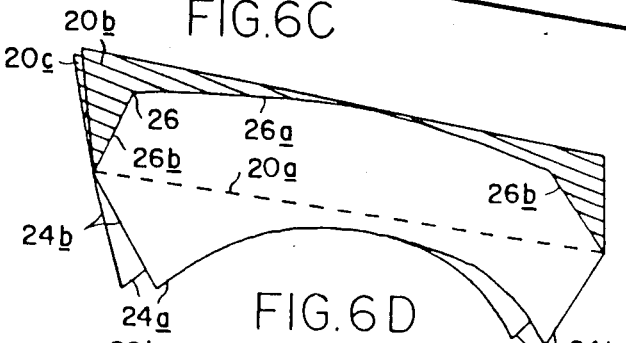
Figure 6E:
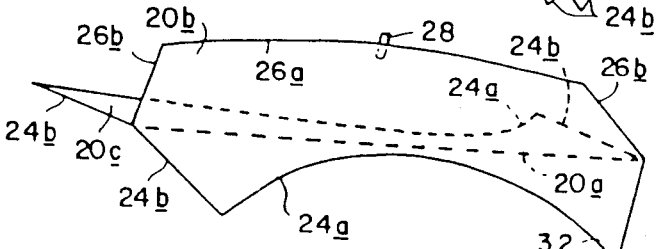

Next, as shown in FIG. 6D, following removal of separator 22, the portions of the sheet plies **20*b* and 20*c* lying behind (i.e. above) the fold line 20*a* in that figure are cut and sealed or seamed along a seam line 26 to form the perimeter of the cushion 30. The excess sheet material above those lines indicated by shading in FIG. 6D is discarded. The upper pair of seamed-together sheet plies and the lower pair of seamed-together sheet plies, seamed along their curved edges at 24*a* and along their opposite end edges at 24*b* and along their outer edges at 26 can now be opened or unfolded along the fold line 20*a* to form the cushion outer cover illustrated in FIG. 6E. Seam line 26 has a gently curved central segment 26*a* and a pair of straight segments 26*b* which extend from the opposite ends of segment 26*a* to the adjacent ends of the seam lines 24*b* located at the original fold line 20*a*. If the cushion is designed for inflation, a conventional air valve 28 may be incorporated into the seam segment 26*a* as shown in FIG. 6E or in the end walls of the cushion. On the other hand, if the cushion is intended to be stuffed, a small gap can be left in a seam line segment, say, segment 26*a***, through which the fill or stuffing can be introduced, following which that gap can be closed or sealed.

Also, if protruding rigid seal or seam edges are formed at the seam lines 24 and 26, prior to completing seam segment 26*a*, the pouch or pocket-like article illustrated in FIG. 6D can be turned inside out so that those edges are concealed and will not be presented to the user of the cushion.

When the pouch-like article illustrated in FIG. 6E is filled or inflated, the flexible walls of that article bulge out to form the completed cushion 30 shown in FIG. 6F. As seen there, the cut and formed sheet plies 20*d* and 20*e* unfold along the original sheet fold line 20*a* to form the radially inner surface of the cushion corresponding to panel 10*c* and portions of the cushion end walls corresponding to panels 10*f* and 10*r* in FIGS. 2A to 2C. The cut and shaped remainders of the sheet plies 20*b* and 20*c* bulge out to form side walls corresponding to the panels 10*b* and 10*a* respectively and the remainders of the end walls corresponding to panels 10*f* and 10*r* in FIGS. 2A to 2C.

As seen in FIG. 6F, the walls of cushion 30 have the same upper and lower cylindrical curvature corresponding to the arcs $C_1$ and $C_2$ depicted in FIG. 3A and approximately the same radius as the neck radius $R_n$. Therefore, the cushion 30 has the same relatively narrow central section and generally triangular end enlargements or flares that characterize the cushion 10 depicted in FIGS. 2A to 2C. Indeed, the ends of cushion 30, like those of cushion 10, are generally triangular and ideally the intersections 31 of seam segments 24*b* and 26*b* are located at the centers of those triangles as clearly seen in FIG. 6F. By properly dimensioning and positioning the cut and seam lines 24 and 26, the pouch shown in FIG. 6E, when filled or inflated properly, will bulge out and deform so that cushion 30 has more or less the same shape as cushion 10 and accordingly produces the same advantages described above for cushion 10. Yet, it is less expensive to make than that cushion. To give cushion 30 a comfortable "feel", conventional flocking indicated at 32 in FIG. 6E may be adhered to the outer surface of the cushion sheet material before or after the cushion is inflated or stuffed. Alternatively, the sheet material may be a laminate of fabric and air-impermeable film thereby providing a cushion that has a comfortable feel while also being inflatable.

Figure 7A:
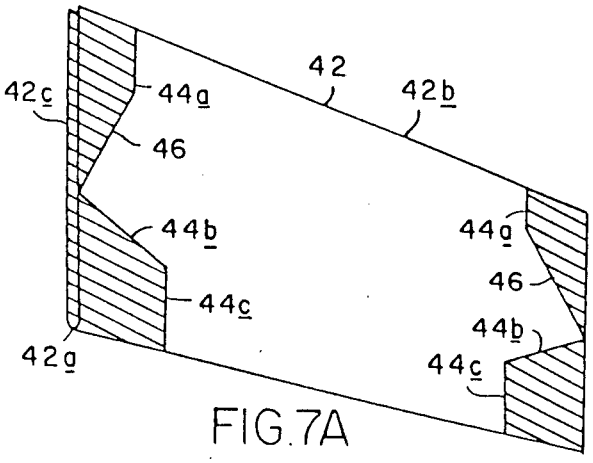
FIGS. 7A to 7F illustrate another method of making a low-cost cushion embodying our invention.
Figure 7B:
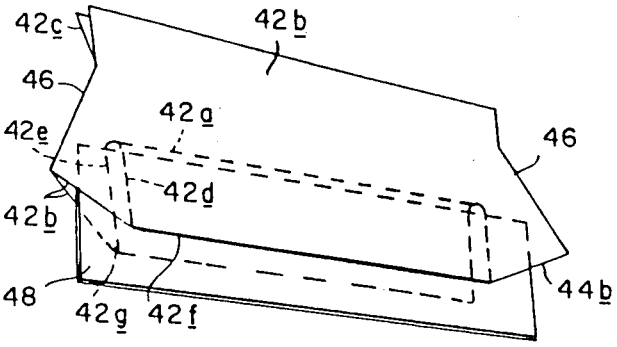
Figure 7C:
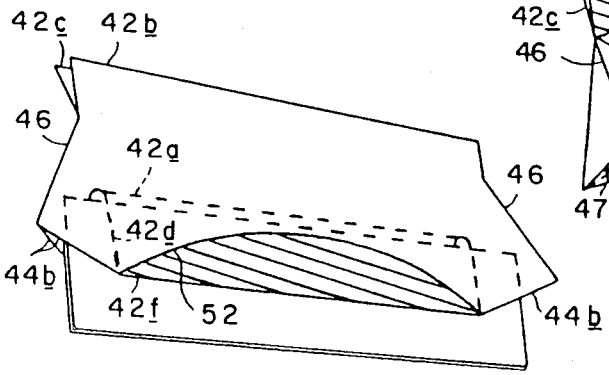
Figure 7E:
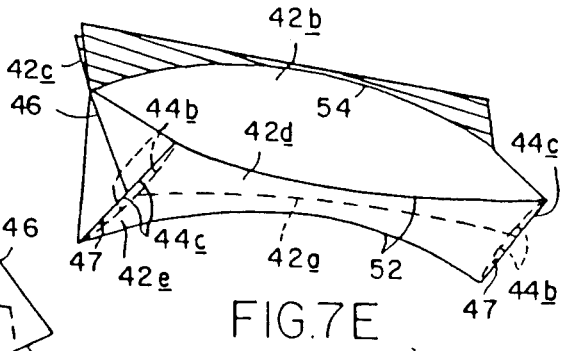
Figure 7D:
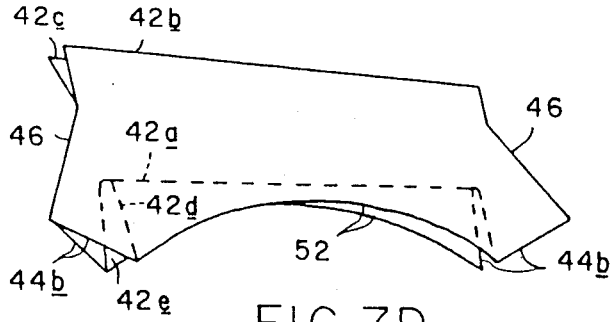
Figure 7F:
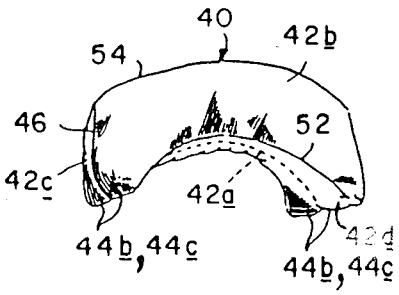

FIGS. 7A to 7E illustrate another method of making a head support cushion embodying our invention, the resulting cushion being shown generally at 40 in FIG. 7F. As in the previous method, a sheet 42 of flexible material is folded over on itself along a fold line 42*a* forming two plies 42*b* and 42*c*. Then both plies of the sheet 42 are cut along lines 44*a*, 44*b* and 44*c* shown in FIG. 7A. Additionally, the two plies 42*b* and 42*c* are sealed or seamed together adjacent their opposite side edges along lines 46, with the excess sheet material indicated by the shading in that figure being discarded.

The cut lines 44*a* and 44*c* are perpendicular to the fold line 42*a*, each line 44*c* being spaced further inboard on the sheet from its corresponding cut line 44*a*. Each cut line 44*b* extends at an angle from the inner end of the corresponding line 44*c* to the adjacent side edge of sheet 42. Each seal line 46 extends from the inner end of the corresponding cut line 44*a* to the end of cut line 44*b* at the corresponding edge of the sheet.

Next, as shown in FIG. 7B, a rigid separator or guide 48 is pushed edge-on against sheet 42 at its fold line 42*a* to reverse fold the sheet 42 to create two internal plies 42*d* and 42*e*. As a result, the two plies 42*b* and 42*d* are joined along a fold line 42*f*, while the two plies 42*e* and 42*c* below the separator are joined along a fold line 42*g*, all as shown in FIG. 7B.

Turning now to FIG., 7C, with the separator 48 still in place, the two plies 42*b* and 42*d* above the separator are cut and sealed along an arcuate seam line 52 with the excess material indicated by the shaded area in FIG. 7C being removed. The seam line 52 has cylindrical curvature corresponding to the curvature of the neck radius $R_n$ in FIG. 3B and its opposite ends are located at the opposite ends of the fold line 42*f*.

The two sheet plies 42*e* and 42*c* below separator 48 are similarly sealed together along a seam line identical to line 52, following which the separator 48 is removed to create the article illustrated in FIG. 7D.

Next, in accordance with the process, the remainders of the two plies 42*d* and 42*e* are unfolded at their fold line 42*a* as shown in FIG. 7E so as to lie flat and the opposite ends of the upper and lower plies 42*b* and 42*c* are folded inward until their lower cut edges 44*b* are aligned with the opposite ends of plies 42*d* and 42*e*, i.e. with their cut edges 44*c* shown in FIG. 7A. Then the adjacent edges 44*b* and 44*c* are sealed or seamed together along their entire lengths as indicated at 47 in FIG. 7E to close the opposite ends of the partially finished pouch.

Then, as shown in FIG. 7E, the two sheet plies 42*b* and 42*c* are cut and sealed together along an upwardly bowed or arcuate seal line 54. This line extends from the upper end of the seal line 46 at one end of the pouch to the upper end of the seal line 46 at the opposite end thereof, the excess material indicated by the shaded areas in FIG. 7E being discarded. The seal line 54 forms the perimeter of the cushion 40. If the various seams described above are likely to produce sharp or stiff edges that could cause user discomfort, the pouch illustrated in FIG. 7E may be turned inside out prior to forming the perimeter seal along line 54.

Prior to completing the seal along line 54, the pouch depicted in FIG. 7E is stuffed with particulate material or a valve is incorporated into the perimeter or an end of the pouch and the pouch filled with air as discussed above to form the finished cushion 40 depicted in FIG. 7F.

As shown in FIG. 7F, when the pouch is properly stuffed or inflated, its various walls bulge out as shown so that cushion 40 has more or less the same shape and curvatures described above in connection with cushions 10 and 30. In this version, however, the flared ends of the cushon each have only a single straight seal along the joined-together lower edges 44*b* and 44*c*. Additionally, cushion 40 has all of the advantages discussed above in connection with cushions 20 and 30.

It will be seen from the foregoing, then, that our cushion provides head support for an individual who has to sit in an upright or semi-reclining position for long periods of time or who wants to relax or sleep while traveling in a moving vehicle. The cushion provides correct anatomical support for all inclined positions of the head so that it minimizes strain on the user's neck and maximizes his comfort and ability to obtain restful sleep should he desire that. The cushion is compact and lightweight and it is situated at only one side of the user's head. Therefore, it is quite comfortable to use and does not obstruct the normal movements of the user's torso. Moreover, the cushion is unobtrusive so that it does not attract attention to the user. When not in use, the cushion can be stored in a briefcase or valise and, if it is inflatable, it can be deflated, rolled up and placed in a pocket or purse. Therefore, it should prove to be a very handy traveling companion, particularly for those required to ride frequently on airplanes, trains or other public conveyances.

It will thus be seen that the objects set forth above, among those made apparent from the preceding description, are efficiently attained, and, since certain changes may be made in the above methods and in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. The method of making a cushion comprising the steps of

A. folding a flexible sheet upon itself along a main fold line to form superimposed upper and lower sheet layers;

B. reverse folding the sheet along upper and lower fold lines so that said main fold line is located an appreciable distance from and generally parallel to said upper and lower fold lines to produce a pair of relatively deep upper and lower internal sheet plies between said upper and lower sheet layers;

C. cutting and joining said upper layer and ply and separately said lower layer and ply along similar inner seam lines (1) extending between widely spaced-apart first and second locations on said upper fold line and between similar locations on said lower fold line respectively, and (2) following similar continuous arcs which curve toward said main fold line;

D. cutting and joining said upper and lower sheet layers along an outer seam line which (1) extends between widely spaced-apart first and second points on said sheet layers and located relatively near said first and second locations thereon, (2) lies on the opposite side of said main fold line from said inner fold lines, and (3) curves away from said main fold line; and E. closing the openings between said sheet layers and plies from said first outer seam line point to said first inner seam line locations and separately from said second outer seam line point to said second inner seam line locations, thereby forming an elongated substantially closed pouch.

2. The method defined in claim 1 wherein the closing step at each end of the pouch is accomplished by A. joining said upper layer and sheet ply and separately said lower layer and sheet ply along first end seam lines extending from said corresponding inner seam line locations to a substantially common point on said main fold line located relatively near said corresponding outer seam line location; and B. joining said upper and lower sheet layers along a second end seam line extending between said common point and said corresponding outer seam line location.

3. The method defined in claim 1 wherein the closing step at each end of the pouch is accomplished by A. cutting said plies along a cut line extending between corresponding said inner seam line locations;

B. joining said upper and lower layers along an end seam line extending from said corresponding outer seam line point to a location outboard of said corresponding cut line;

C. unfolding said sheet plies along said main fold line so that said plies lie substantially in the same plane;

D. folding the upper and lower sheet layers inward along lines extending generally from the corresponding outer seam line point to the corresponding inner seam line locations until said portions engage the corresponding ends of said upper and lower plies along a line of engagement; and E. joining said upper and lower sheet layers to said plies along said line of engagement.

4. The method defined in claim 1 and including the additional step of filling said pouch with resilient matter.

5. The method defined in claim 4 including filling the pouch with foam material.

6. The method defined in claim 1 and including the additional steps of forming said pouch of air-impermeable sheet material and incorporating air filling means into said pouch.

7. The method defined in claim 1 including the additional step of applying fluid-absorbent material to said sheet surface that forms the outer surfaces of said pouch.

8. The method defined in claim 1 and including the additional step of turning said pouch inside out prior to completing all of the seam lines in said pouch.

* * * * *